US007877912B1

(12) United States Patent
Ley-Owens

(10) Patent No.: US 7,877,912 B1
(45) Date of Patent: Feb. 1, 2011

(54) OVERLAY FOR SIGNS

(76) Inventor: Lorraine C. Ley-Owens, 26 Penfield St., Roslindale, MA (US) 02131

( * ) Notice: Subject to any disclaimer, the term of this patent is extended or adjusted under 35 U.S.C. 154(b) by 161 days.

(21) Appl. No.: 12/390,004

(22) Filed: Feb. 20, 2009

Related U.S. Application Data

(60) Provisional application No. 61/031,255, filed on Feb. 25, 2008.

(51) Int. Cl.
*G09F 13/16* (2006.01)

(52) U.S. Cl. ..... 40/582; 40/612

(58) Field of Classification Search ..... 40/582, 40/612

See application file for complete search history.

(56) References Cited

U.S. PATENT DOCUMENTS

| | | | | |
|---|---|---|---|---|
| 1,955,179 | A * | 4/1934 | Force | 359/543 |
| 2,621,431 | A * | 12/1952 | Rericker | 40/612 |
| 4,090,464 | A | 5/1978 | Bishopp et al. | |
| 4,250,646 | A * | 2/1981 | Trachtenberg | 40/582 |
| 5,023,607 | A * | 6/1991 | Staten | 340/908.1 |
| 5,050,327 | A * | 9/1991 | Woltman | 40/582 |
| 5,675,923 | A * | 10/1997 | Sarkisian et al. | 40/612 |
| 6,029,382 | A | 2/2000 | Kochanowski | |
| 6,073,378 | A | 6/2000 | Gabbert | |
| 6,148,555 | A | 11/2000 | Beauchamp et al. | |
| 6,209,598 | B1 | 4/2001 | Petrey | |
| 6,239,691 | B1 * | 5/2001 | Preisler | 340/321 |
| 6,407,675 | B1 * | 6/2002 | Mumford et al. | 340/907 |
| 7,386,928 | B1 * | 6/2008 | Crorey | 29/453 |
| 2003/0110673 | A1 * | 6/2003 | Tomboris | 40/612 |
| 2010/0101126 | A1 * | 4/2010 | Keil | 40/582 |

* cited by examiner

*Primary Examiner*—Gary C Hoge
(74) *Attorney, Agent, or Firm*—Sturm & Fix LLP

(57) ABSTRACT

The present invention provides an overlay for conventional signs that provides multi-dimensional visibility. The overlay includes a number of individual trim sections disposed around the peripheral edge of the sign. The trim sections have an interior slot that engages the peripheral edge, and a reflective surface on the rear portion, and optionally on the edge portion, of each trim section. A connecting cable is received in a channel of each trim section, and the free ends of the cable and connected to secure the trim sections in place around the sign.

17 Claims, 4 Drawing Sheets

OVERLAY FOR SIGNS

CROSS REFERENCE TO RELATED APPLICATIONS

This application claims the benefit of U.S. Provisional Patent Application Ser. No. 61/031,255, filed Feb. 25, 2008, entitled "Overlay for Signs", which is incorporated herein by reference.

BACKGROUND OF THE INVENTION

1. Field of the Invention

The present invention relates to the field of signage, and more particularly to an overlay for conventional signs.

2. Description of Related Art

As can be seen by reference to the following U.S. Pat. Nos. 4,090,464; 6,029,382; 6,073,378; 6,148,555; and 6,209,598, the prior art is replete with myriad and diverse signage systems.

While all of the aforementioned prior art constructions are adequate for the basic purpose and function for which they have been specifically designed, they are uniformly deficient with respect to their failure to provide a simple, efficient, and practical overlay for conventional signs to provide multi-dimensional visibility.

As a consequence of the foregoing situation, there has existed a longstanding need for a new and improved overlay for conventional signs, and the provision of such a device is a stated object of the present invention.

BRIEF SUMMARY OF THE INVENTION

Briefly stated, the present invention provides an overlay for conventional signs that provides multi-dimensional visibility. The overlay includes a number of individual trim sections disposed around the peripheral edge of the sign. The trim sections have an interior slot that engages the peripheral edge, and a reflective surface on the rear portion, and optionally on the edge portion, of each trim section. A connecting cable is received in a channel of each trim section, and the free ends of the cable and connected to secure the trim sections in place around the sign.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with drawings, wherein.

DETAILED DESCRIPTION OF THE INVENTION

Figure 1:
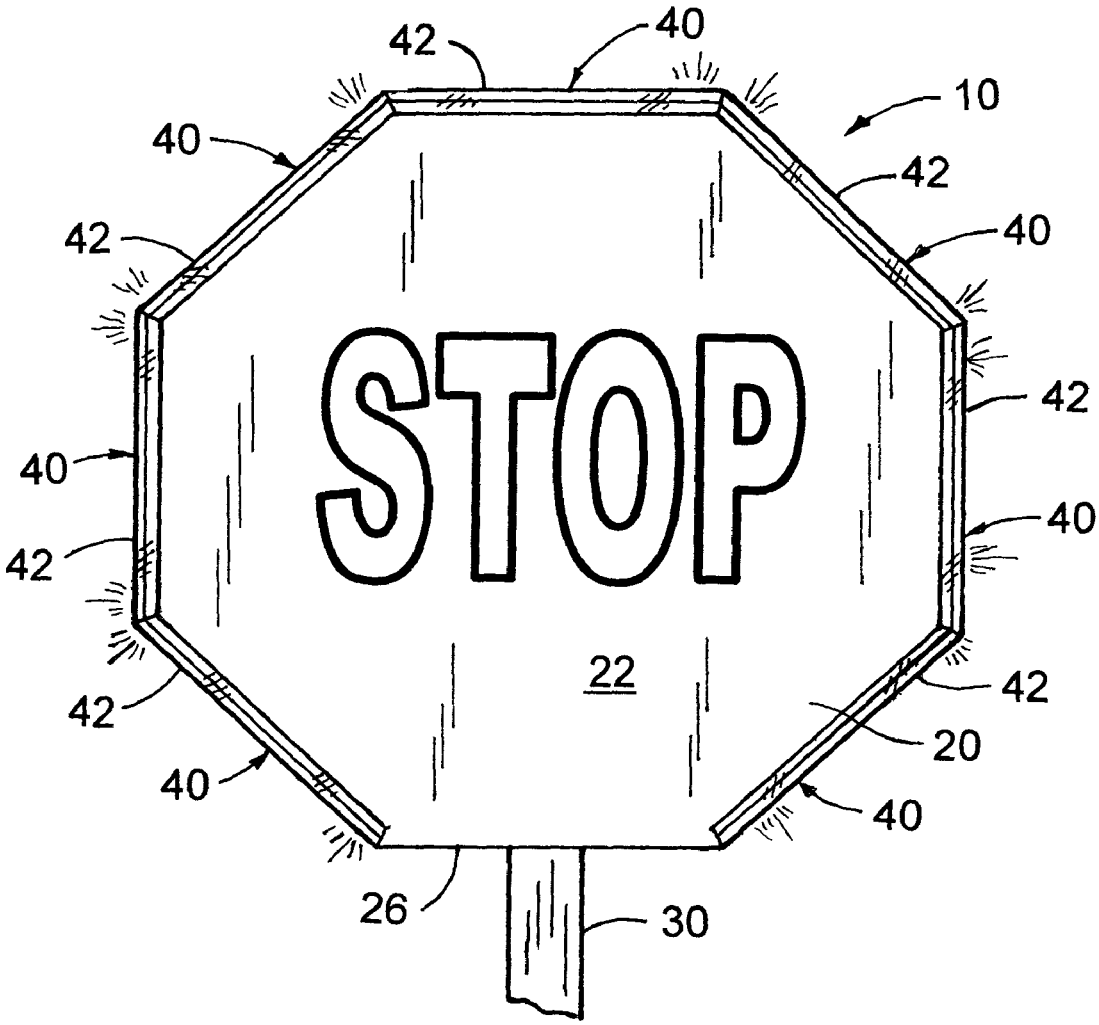
FIG. 1 is a front elevational view showing the overlay of the present invention secured to a conventional stop sign.
Figure 2:
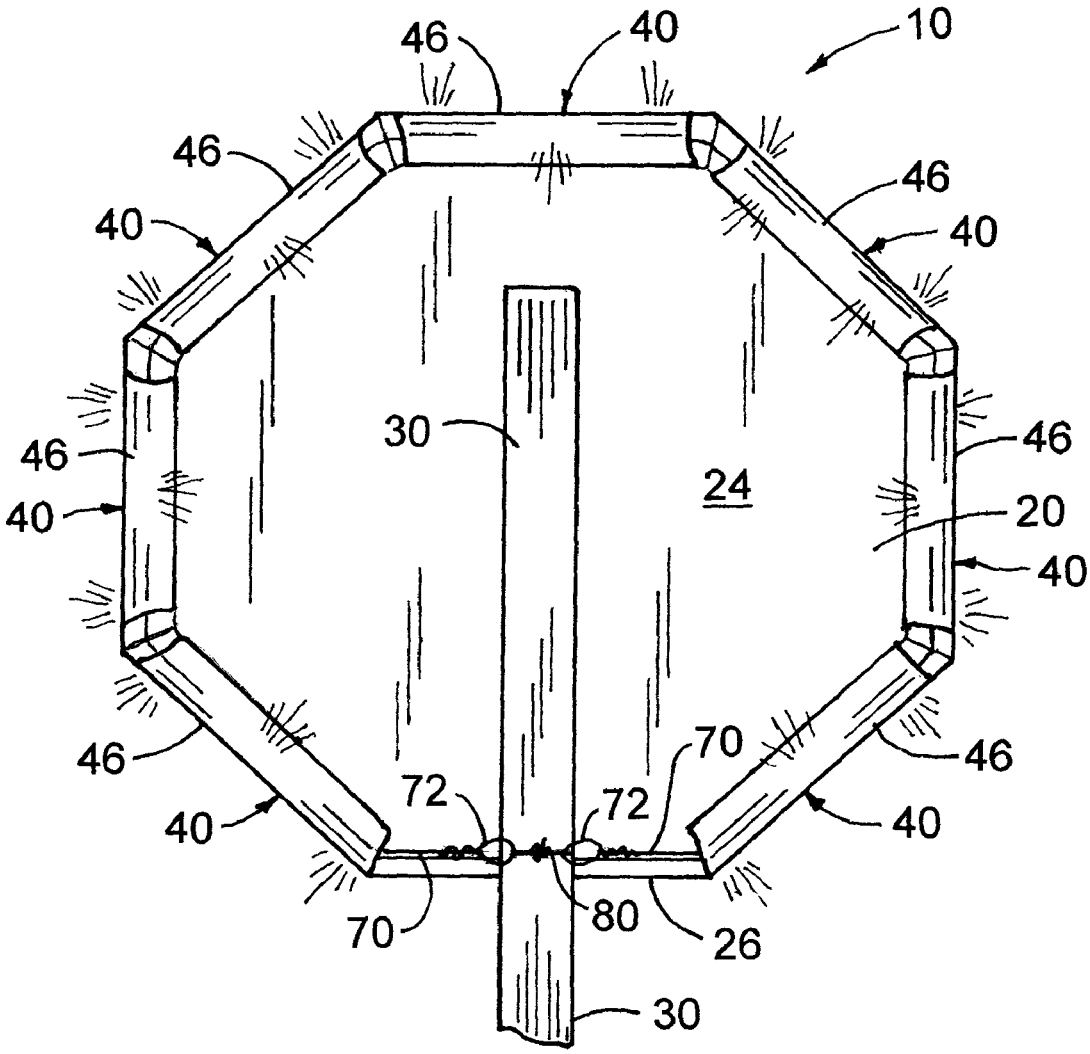
FIG. 2 is a rear elevational view thereof.
Figure 3:
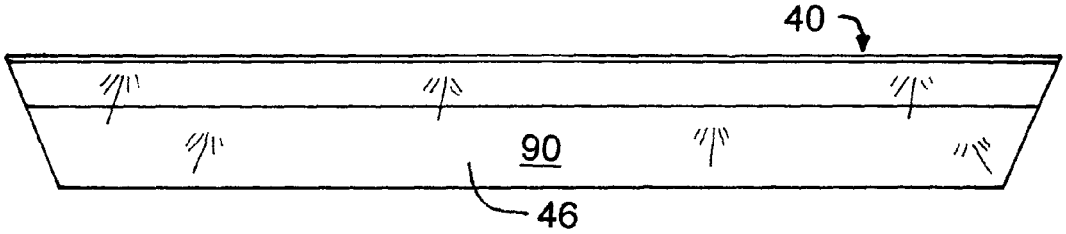
FIG. 3 is an enlarged rear elevational view of one of the trim sections included in the overlay.
Figure 4:
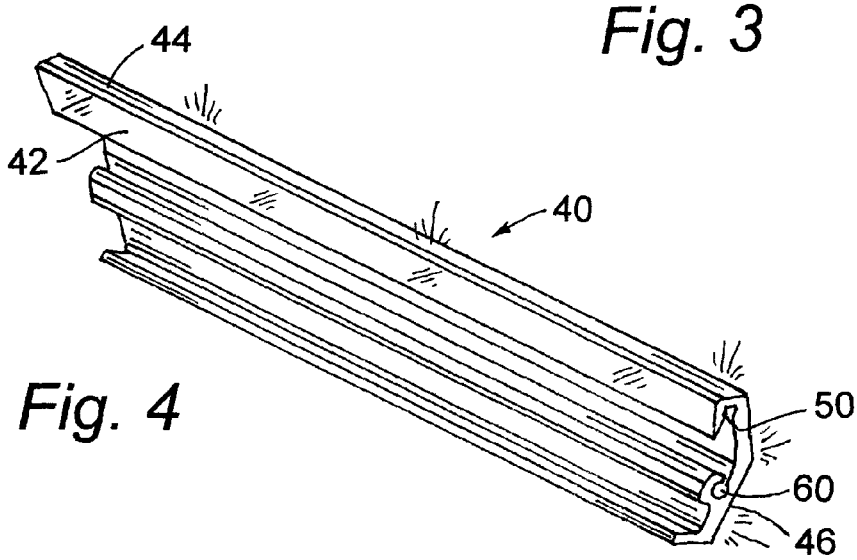
FIG. 4 is a front perspective view of one of the trim sections.
Figure 5:
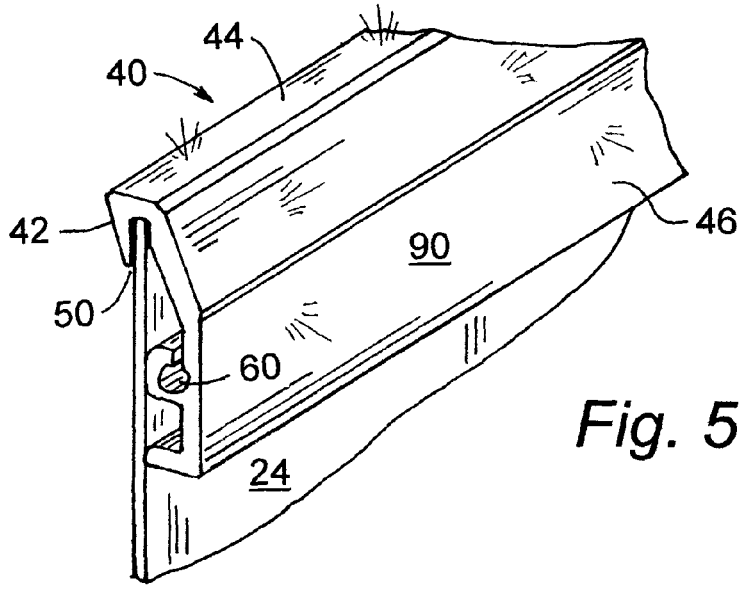
FIG. 5 is a partial rear perspective sectional view illustrating the engagement of the trim section on the peripheral edge of the sign.
Figure 6:
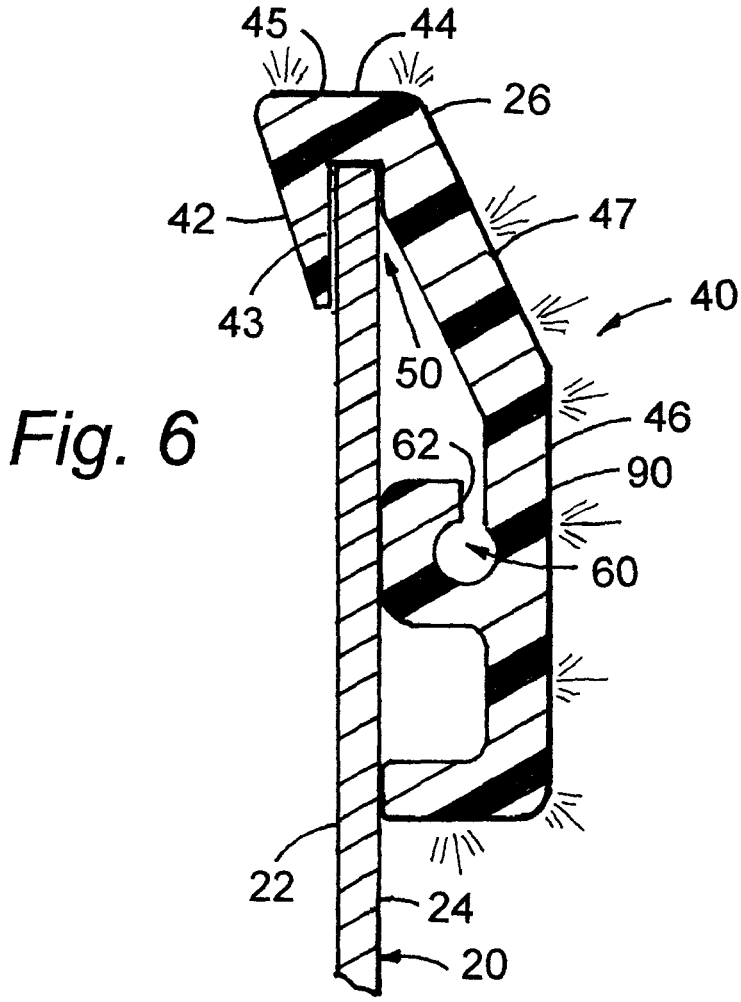
FIG. 6 is an end sectional view of the trim section.
Figure 7:
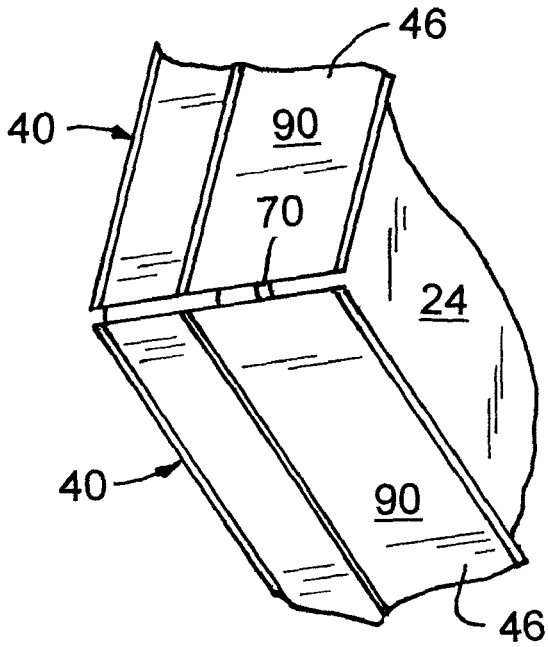
FIG. 7 is a rear elevational view showing the joint of two adjacent trim sections.

As can be seen by reference to the drawings, the sign overlay that forms the basis of the present invention is designated generally by the reference to number 10. The sign overlay 10 is illustrated attached to a conventional stop sign 20 secured to a support post 30. The sign 20 has a front surface 22, a rear surface 24, and a peripheral edge 26.

The overlay 10 includes a plurality of trim sections 40 disposed around the sign 10. Each trim section 40 has a front portion 42, an edge portion 44, and a rear portion 46. The inner faces 43, 45, 47 of the front, edge and rear portions 42, 44, 46, forms an interior slot 50 that matingly engages the peripheral edge 26 of the sign 20. A channel 60 extends in from the inner face 47 of the rear portion 46 and an opening 62 facing the interior slot 50 is disposed to receive a connecting cable 70, such as a nylon coated stainless steel or PVC cable. The cable 70 has free ends 72 releasably connected by a coupler 80, such as a nylon zip tie.

The trim sections 40 are formed of extruded plastic, such as transparent ABS (MABS), acrylic (PMMA), or polycarbonate (PC.) A UV stabilized polycarbonate is the preferred material due to impact resistance and durability. The front portion 42 of the trim sections 40 is transparent, while the rear portion 46, and optionally the edge portion 44, carries a reflective surface 90. The reflective surface may be a red, retro-reflective tape (such as 3M® Diamond Grade™ Conspicuity Marking Roll 983-72, Red) or a retro-reflective red paint that meets appropriate signage standards.

This novel product can be described as a highly reflective plastic trim for traffic signs. The drawings show a product for conventional stop signs measuring 30" by 30". Design dimensions can be modified for stop signs of any size, (e.g., 24 by 24 etc.) Other variations of the overlay include trims for a variety of regulatory and non-regulatory traffic signs.

The sign overly for conventional stop signs measuring 30" by 30" is illustrated as seven extruded trim sections 40 strung over a cable 70 much like beads on a necklace. The outer face of the trim sections 40 from the edge 44 to rear portion 46 is covered with a red retro-reflective material 90. A clear beveled front portion 42 grips the front of stop sign 20. The cable 70 is carried in the channel 60 and travels around nearly the entire perimeter and fastens at the bottom of the sign 20 with a coupler 80 for tamperproof security.

A stop sign 20 is a polygon of eight angles and eight sides. For installation, the top of the stop sign 20 is considered as the number one side and the bottom of the stop sign 20 as the number five side. Counting clockwise from the top, the first section of the trim 40 is placed onto the number four (or number six) side to begin. Each trim section 40 is pushed on separately, with the cable 70 bending around the corners of the sign 20. The cable 70 has a small loop at each free end 72 of the assembly to allow it to be connected via a plastic zip tie 80 once the trim sections 40 are mounted on the sign 20. The trim 40 may already be on the cable 70 in the final manufacturer completed assembly. To uninstall, the installer simply cuts plastic zip tie coupler 80 and removes the assembly 10. The trim sections 40 may potentially be reused with new zip tie 90. Only seven trim sections 40 will be used in the assembly due to interference of the stop sign post 20. However, if necessary, trim sections 40 can be removed to accommodate other post irregularities.

Major features and benefits of the present invention include: (1) improved visibility of signs during the day, dawn, and dusk; (2) improved visibility of signs that may be obstructed from view in some manner, (e.g., a stop sign blocked by a Do Not Enter sign); (3) highlights and outlines signs from the rear and side for viewing at multiple angles; (4) provides advanced notification of traffic situations; (5) an effective countermeasure that will reduce points of conflict at stop controlled intersections; (6) extends life of traffic signs while providing the same regulatory guidance yet in a multi dimension manner; (7) low cost; (8) aids motorist in the practice of defensive driving especially older Americans with deteriorating vision. The latest census bureau statistics indicate a growing population of senior citizen drivers. Drivers aged 65 and older will increase to 70 million by 2030. All motorists will benefit from this improvement in traffic signage.

Our Federal Government has identified a serious national concern for safety on rural roads. This product offers a low cost reflective solution that will improve driving safety especially on rural roads where lighting is low or non-existent. The product provides positive guidance for drivers in that it does not change the message of the regulatory sign, but provides needed multi-dimensional information, by increasing conspicuity of the sides and back of the sign.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An overlay for a conventional sign having a front surface, a rear surface, and a peripheral edge, the overlay comprising:

a plurality of trim sections disposed around the sign, each of the trim sections including a front portion, an edge portion, and a rear portion, the front, edge, and rear portions each having an outer face and an inner face;

a first reflective surface carried on the outer face of the rear portion of each of the plurality of trim members;

an interior slot formed by the inner faces of the front, edge, and rear portions of each of the plurality of trim members, the interior slot being disposed to matingly engage the peripheral edge of the sign;

a channel disposed on the rear portion of each of the plurality of trim sections, the channel having an opening disposed to face the interior slot;

an elongated connecting cable having free ends, the cable being disposed to be received in the channel of each of the plurality of trim sections through the openings; and a coupler disposed to releasably connect the free ends of the cable.

2. The overlay of claim 1, wherein the front portion of each of the plurality of trim sections is transparent.

3. The overlay of claim 1 wherein the outer face of the edge portion of each of the plurality of trim sections carries a second reflective surface.

4. The overlay of claim 2, wherein the outer face of the edge portion of each of the plurality of trim sections carries a second reflective surface.

5. The overlay of claim 1, wherein the sign is a stop sign having eight sides.

6. The overlay of claim 5, wherein the sign is mounted on a post disposed to engage the rear surface of the sign between a lowermost side of the eight sides of the sign and a point spaced below an uppermost side of the eight sides of the sign, and wherein seven adjacent trim sections are attached to the sign leaving a space at the lowermost side of the sign.

7. The overlay of claim 1, wherein the channel is disposed to extend out from the inner face of the rear portion of each of the plurality of trim sections.

8. The overlay of claim 2, wherein the channel is disposed to extend out from the inner face of the rear portion of each of the plurality of trim sections.

9. The overlay of claim 3, wherein the channel is disposed to extend out from the inner face of the rear portion of each of the plurality of trim sections.

10. The overlay of claim 4, wherein the channel is disposed to extend out from the inner face of the rear portion of each of the plurality of trim sections.

11. The overlay of claim 5, wherein the channel is disposed to extend out from the inner face of the rear portion of each of the plurality of trim sections.

12. The overlay of claim 6, wherein the channel is disposed to extend out from the inner face of the rear portion of each of the plurality of trim sections.

13. The overlay of claim 1, wherein each of the plurality of trim sections is formed of extruded plastic.

14. The overlay of claim 1, wherein the first reflective surface includes a reflective tape.

15. The overlay of claim 1, wherein the first reflective surface includes a reflective paint.

16. The overlay of claim 3, wherein the first reflective surface includes a reflective tape.

17. The overlay of claim 3, wherein the first reflective surface includes a reflective paint.

* * * * *